US008319662B1

(12) United States Patent
Bontemps et al.

(10) Patent No.: US 8,319,662 B1
(45) Date of Patent: Nov. 27, 2012

(54) ULTRA PORTABLE TRAFFIC MANAGEMENT SYSTEM

(76) Inventors: Evan J. Bontemps, Newmarket, NH (US); Thomas F. Terrien, Jr., Portsmouth, NH (US)

( * ) Notice: Subject to any disclaimer, the term of this patent is extended or adjusted under 35 U.S.C. 154(b) by 637 days.

(21) Appl. No.: 12/506,726

(22) Filed: Aug. 5, 2009

Related U.S. Application Data

(60) Provisional application No. 61/218,967, filed on Jun. 21, 2009.

(51) Int. Cl.
*G08G 1/095* (2006.01)

(52) U.S. Cl. ..... 340/908; 340/907; 340/908.1

(58) Field of Classification Search ..... 340/907, 340/908, 908.1, 321, 472, 473; 116/63 P, 116/63 R
See application file for complete search history.

(56) References Cited

U.S. PATENT DOCUMENTS 4,447,802 A * 5/1984 Bose ..... 340/473
5,400,019 A * 3/1995 Riscoe, Jr. ..... 340/908
5,659,305 A * 8/1997 Rains et al. ..... 340/931
5,900,826 A * 5/1999 Farber ..... 340/908
5,986,576 A * 11/1999 Armstrong ..... 340/908
2003/0067399 A1* 4/2003 Wesley ..... 340/907
2006/0273924 A1* 12/2006 Schwartz ..... 340/907
2007/0126599 A1* 6/2007 Gembala et al. ..... 340/908
2008/0129543 A1* 6/2008 Lee ..... 340/908
2008/0198038 A1* 8/2008 Yingst et al. ..... 340/908
2009/0058680 A1* 3/2009 Benn ..... 340/908.1

* cited by examiner

*Primary Examiner* — Brent Swarthout
(74) *Attorney, Agent, or Firm* — Joseph E. Funk

(57) ABSTRACT

A portable traffic control unit for temporary use is disclosed that is capable of both automatic and manual operation. The unit is modular and is small enough and light enough that it is easily carried in a police, emergency or other vehicle and can be set up and programmed for use by one person. The unit has a bright LED display typically having red, orange, green lights, and flashing white strobe LEDs that are microprocessor controlled. The unit has a radio receiver that receives RF signals used to control the operation of the unit, and the signals are received from a handheld RF transmitter used at the site of the unit, or are received from an RF transmitter at a remote control site. Various sensors may be attached to the unit to provide information that is transmitted to the handheld remote control and/or to the remote control site using an RF transmitter that is part of the unit. Multiple traffic control units operating at a common site can communicate with each other to facilitate operations.

19 Claims, 12 Drawing Sheets

ULTRA PORTABLE TRAFFIC MANAGEMENT SYSTEM

RELATED APPLICATION

This utility patent application claims benefit under U.S. Provisional Patent Application No. 61/218,967, entitled "Ultra Portable Traffic Management System", filed on Jun. 21, 2009.

FIELD OF THE INVENTION

This invention relates to portable, temporary traffic management systems that may be used in emergency, road work and other situations and which can be easily set up and operated by one person, or operate in unattended automatic modes when needed.

BACKGROUND OF THE INVENTION

Traditional traffic control for highway road works and the like is accomplished by one or more policemen or traffic control persons known as "flagmen", that are individuals with handheld signs or flags redirecting traffic or signaling the traffic to slow down or stop for road works or other activity ahead. In addition, at vehicular accident sites one or more policemen often must manage traffic flow while another policeman must gather information, take pictures, call for fire trucks and ambulances, etc. Too often, the extra police officers are not available for assignment to an accident or emergency site and the situation can be dangerous to all people at the site due to lack of traffic control. Indeed, other accidents may occur at an existing accident or emergency site due to the lack of adequate traffic control.

Portable traffic management systems are also valuable when special events create a temporary need to control an abnormal heavy traffic flow or where lack of power supply exists.

Using flagmen, law enforcement or emergency personnel to control traffic at vehicular accidents, emergency sites, special events, etcetera is dangerous when it is dark and in inclement weather because it is difficult to see such personnel even when they have flashlights.

Somewhat portable traffic management systems are used in some instances, where elaborate and relatively long-term road works are undertaken. These are usually self-powered units carried on trailers along with generators. However, the trailer carried portable traffic management systems are not very practical at accident or other emergency sites where they are needed almost instantly because of the length of time involved in arranging for the use of one, transporting them the accident site, physically setting them up and programming them.

Various portable traffic management devices exist in the prior art. For example, see U.S. Pat. No. 5,400,019 issued to Riscoe, Jr. which discloses a portable traffic light including an adjustable tripod stand with a traffic light assembly secured thereto. The traffic lights are controlled with a control circuit including a programmable timer.

Thus, there is a need in the prior art for a mobile traffic signal apparatus that is relatively light, is reliable, simple to use, quick to set up, and easy to deploy by only one person.

In addition, there is a need in the prior art for a portable traffic management system or unit that may be carried in a police car or an emergency vehicle, and that when needed at an accident, emergency or other site may be taken out and quickly and easily set up to facilitate traffic control at the site.

There is also a need for a portable traffic management system or unit that may be quickly and easily programmed at a site of use, may be easily remote controlled using a handheld remote controller at site of use, and may be controlled from remote to the site of use.

Of great importance is to provide a portable traffic management system or unit that can be produced economically, collapses to a size small enough to carry in a small car or other vehicle, and every governmental authority and company that performs work on or alongside roads can maintain an inventory of portable traffic lights in police cars, emergency vehicles and other vehicles to be readily used as needed.

SUMMARY OF THE INVENTION

The needs in the prior art described in the previous paragraphs are met by the present invention. A collapsible, relatively light, ultra portable, traffic management unit is disclosed that may be carried in police cars, emergency vehicles, or other vehicles. At an accident site, site of an emergency, site of road work, work alongside a road side, or wherever else needed for traffic and pedestrian crossing control, one person may take the traffic management unit out of the vehicle in which it is carried, and quickly and easily set it up and program it for use.

The novel traffic management unit may be manually programmed for operation by using controls on the unit. The unit also has radio frequency (RF) elements that are used to receive RF signals to program or to change a program running in a microprocessor inside the traffic management unit. A handheld controller may be used to initially set up or to change visual traffic control signals generated by the unit while it is in use.

The use of the novel traffic management unit is, for example, advantageous in road work situations where two or more flagmen must be used to alternately control the direction of vehicular traffic through a work area. With the use of one of the novel traffic management units at either end of a road work area and a hand held controller one person can properly control the flow of vehicular traffic through the work area. Similarly, a single police, emergency or other personnel can initially set up or change the visual traffic signals emitted by one or more traffic management units at an accident or emergency site using the hand held controller. Alternatively, the operator of a traffic management unit can program the system to operate automatically and unattended.

In addition, the radio frequency control elements within a traffic management unit may receive RF control signals that are transmitted from a site remote to the location of a traffic management unit to change the visual control signals emitted by the unit. For example, after a peak traffic condition at a location where a traffic management unit is located, an RF signal sent from a remote site may change the visual traffic control signals displayed by an LED light assembly from red-green (stop-go) to an orange blinker. This can be done at specific times of the day when a blinker is sufficient traffic control, or manually responsive to an image from a video camera at the site. In the UK, vehicular and pedestrian traffic cameras are widely used and their video signals are transmitted back to a central monitoring site. The video signals may indicate a change in conditions that warrant a change in the operating status of a traffic management unit. Alternatively, a video camera may be mounted on the traffic management unit and its signals are transmitted back to the central monitoring site.

The RF elements in the traffic management unit include a transmitter to transmit encoded RF signals with information from various sensors and other electronics that may be mounted in the control unit or on the traffic management unit. These sensor and other signals are transmitted to a remote control site. The sensors may perform many functions. For example, they may sense the remaining power in the battery power supply for the unit, provide GPS position information indicating the physical location of the unit, and to indicate if the unit has been moved from the site where it is set up.

A tamper switch is included with the control unit, and the switch activates if the traffic management unit is moved even a small amount, which may indicate that the unit is wrongfully being moved in a possible theft attempt. The operation of the tamper switch causes a microprocessor in the control unit to cause an appropriate signal to be transmitted using the RF transmitter. The signal is received at the remote control site, and police or other personnel would be immediately dispatched to the location of the traffic management unit. The tamper switch would also be activated if the traffic management unit is moved inadvertently or by accident which could affect the visual view of the LED light assembly, so the police or other personnel dispatched to the location of the traffic management unit can correct the physical orientation of the unit.

National security and environmental sensors/detectors may also be integrated into the traffic management unit. The outputs of these sensors/detectors are transmitted back to the remote control site for appropriate analysis and action, or to be forwarded to another location for such monitoring and analysis. Depending on specific needs, the sensors may include, for example, a radiation detector, an explosive detector, a humidity sensor, a temperature sensor, air quality sensor, water quality sensor, UV radiation sensor, vehicle proximity sensor, emergency vehicle transmitter sensor, accelerometers, deployed height of unit sensor, traffic counter, seismic sensor, etcetera. A radar unit may also be attached. Many types of electronic equipment may be attached to the traffic management unit, and their signals transmitted via the RF transmitter of the control unit back to the remote control site for appropriate processing.

The traffic management unit is comprised of a durable stand with an adjustable telescoping vertical pole and base with adjustable legs which retract for storage and expand for use of the unit. A bright LED display assembly and an emergency strobe light/sensor are attached to the top of the pole. Attached to the base during setup are an extended temperature range battery pack and its associated electronic equipment. Some sensors and other electronics may be included with the control unit, and some may be mounted on the stand apart from the battery pack.

The battery pack may contain two or more battery units for powering the electronic equipment and visual display of the unit that are mounted to the stand base. The control unit, battery and LED light assembly are interconnected by sealed plug-in cables. Some types of sensors and other types of electronic equipment may be also attached to stand base 11, while other sensors may be attached to the vertical pole of stand base 11, near its bottom or near the top of the pole as required for their proper operation. The LED light assembly is controlled by a microprocessor in the control unit to provide visual traffic control signals as programmed into the control unit. The control unit may be programmed using a hand held controller in proximity to the traffic management unit, or from a remote control site, by using an RF receiver that is included with the electronics in the control unit. Also included in the control unit is an RF transmitter that is controlled by the microprocessor to transmit signals from various sensors and the tamper switch directly to the remote control site.

The pieces of the traffic management unit are modular and may be easily assembled and setup, or disassembled and collapsed to store in a bag that is the size of a large gym bag, or in any other type of container, and the bag or container is easily stored in a small vehicle.

DESCRIPTION OF THE DRAWING

The invention will be better understood upon reading the following Detailed Description in conjunction with the drawing in which.

DETAILED DESCRIPTION

Figure 1:
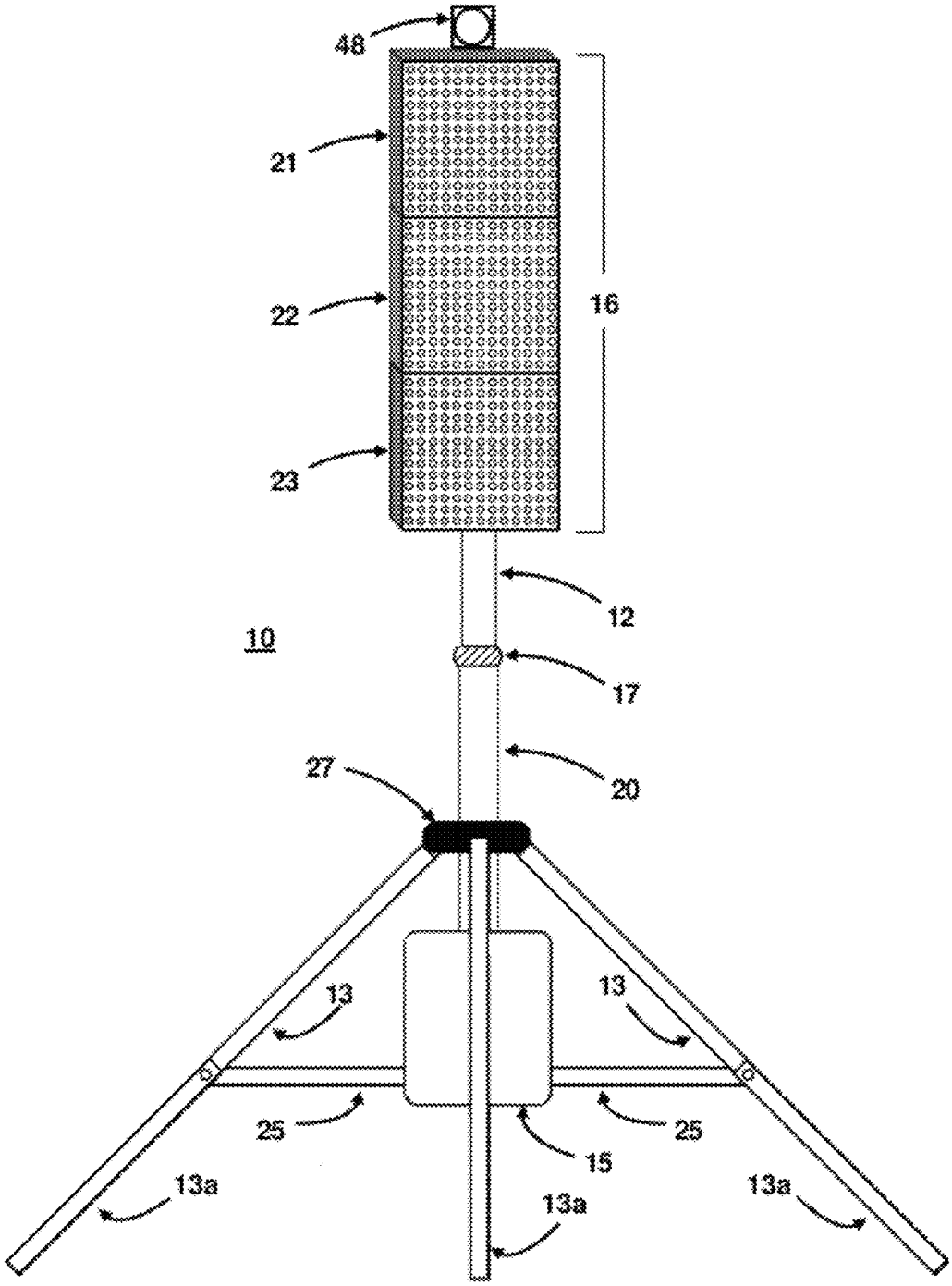
FIG. 1 shows a perspective view of an assembled traffic management unit.
Figure 2:
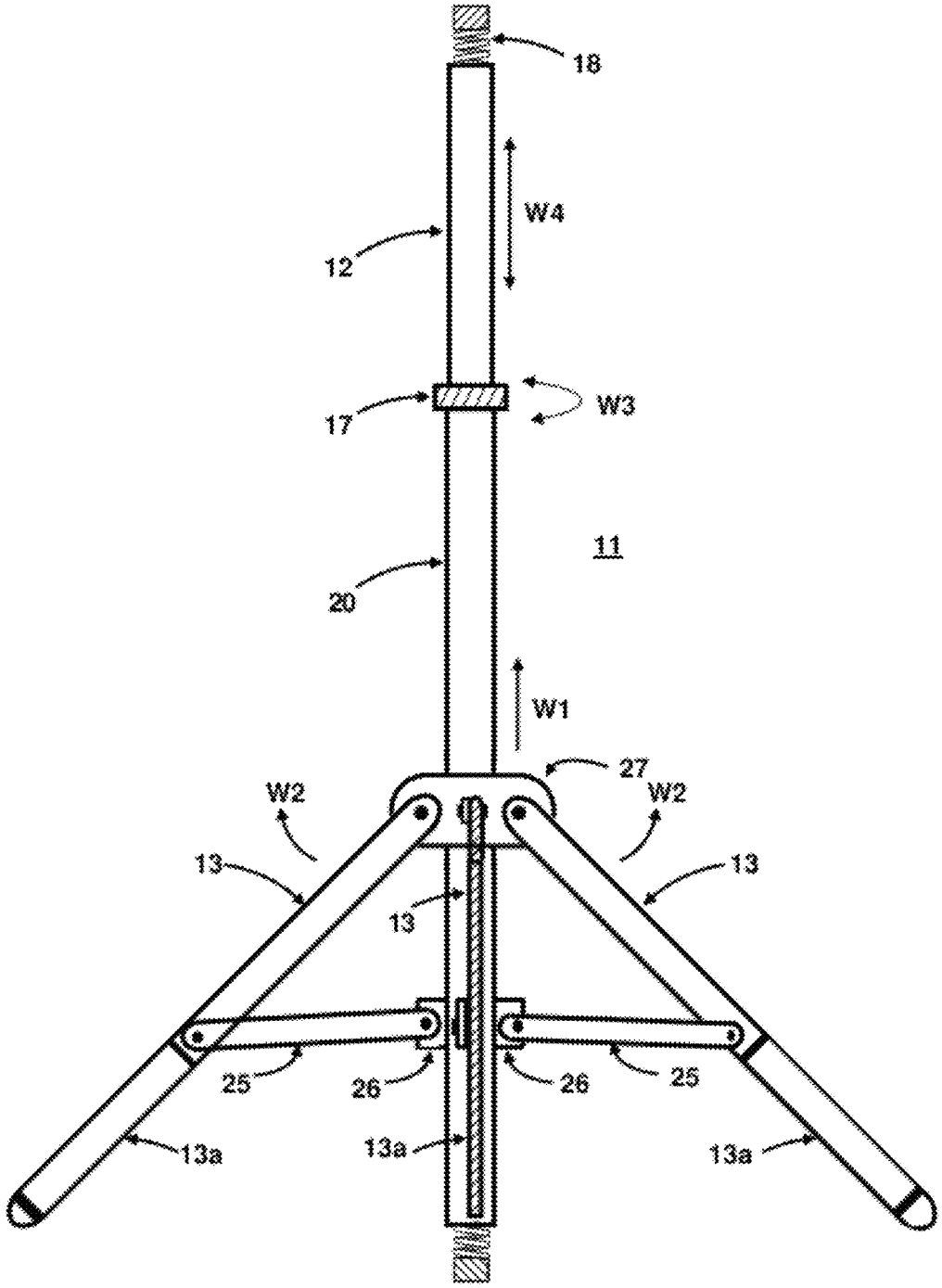
FIG. 2 shows a perspective view of a tripod base of the traffic management unit.
Figure 10:
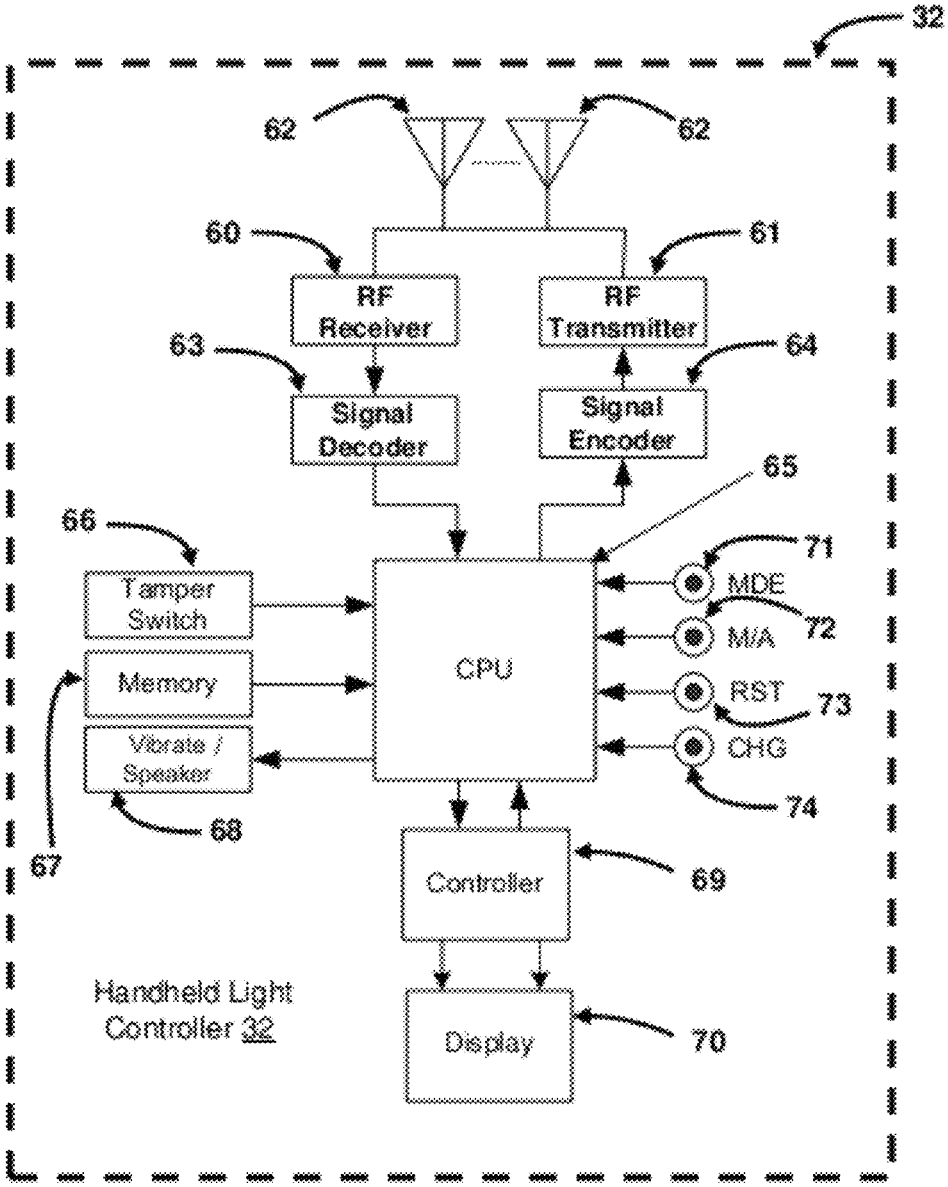
FIG. 10 is a block diagram of a handheld controller for programming and manually operating the traffic management unit.

In FIG. 1 is shown a perspective view of an assembled, portable traffic management unit 10. A unique feature of traffic management unit 10 that facilitates its portability is its ease of assembly and setup, and its ease of disassembly and collapsibility into a relatively small package that can easily be stored in a vehicle. A handheld RF remote control unit 32 for operating the control unit 14 of traffic management unit 10 is not shown in this figure, but is shown in FIG. 10. Briefly, there is an adjustable vertical length stand base 11 that is well known in the art. It has extendable legs 13 and a lower vertical portion 20. The legs 13 each have an extendable portion 13*a* for positioning unit 10 on non-level and uneven surfaces. Only three legs 13 are shown in FIGS. 1 and 2 for the sole purpose of not cluttering the drawing, but in reality there are usually five legs 13. There is also an extendable upper vertical portion 12 that is extended from within the lower vertical portion 20 in a manner well known in the art. There are many mechanisms for extending and locking upper portion 12 to lower portion 20. A twist lock nut 17 is shown only for the sake of illustration. An LED light assembly 16 is mounted on top of the upper vertical portion 12. Atop light assembly 16 is an emergency strobe light/sensor 48 and in addition to integrated white strobe LEDs in 21 that are flashed during inclement weather conditions to draw motorists attention to the traffic control conditions indicated by the various illumination states of light assembly 16. Although not shown in the drawing, there are also perimeter flashing blue lights to meet certain Federal and state police requirements. A battery unit 15 is fastened to lower portion 20 of stand base 11 and a cable 18 interconnects LED light assembly 16, control unit 14 and battery unit 15. When cable 18 is plugged into battery unit 15, it is a watertight connection. Various sensors (not shown) may also be attached to the two portions of stand base 11 and on top of LED light assembly 16. The sensor signals are usually transmitted to a remote site. This is described further in the detailed description. These sensors may include a radar unit for monitoring traffic conditions and, when the coupled with the location information from a GPS receiver, heuristic intelligent traffic control management information is obtained that may be used to control traffic management unit 10 to minimize severe queuing of vehicles during traffic accidents.

To set up traffic management unit 10, the legs 13 of stand base 11 are first extended outward in a manner well known in the art. The integrated battery pack 15 is fastened to the bottom of lower portion 20 of stand base 11 as shown in FIG. 1. LED light assembly 16 is then affixed to the top of upper vertical portion 12 of stand base 11. There is a coiled cable 18 interconnecting battery pack 15, control unit 14 and LED light assembly 16 that is fully contained inside, and protected by, hollow upper and lower vertical portions 12 and 20 of stand base 11. Power is sent to LED light assembly 16 and control unit 14 via cable 18. As upper and lower vertical portions 12 and 20 are telescoped outward the coiled wire 18 therein extends. When cable 18 is plugged into light assembly 16, it is a watertight connection.

Next, twist lock nut 17 is loosened and upper vertical portion 12 is withdrawn upward from inside lower vertical portion 20 and twist nut 17 is tightened. This leaves light assembly 16 raised many feet into the air. Other locking mechanisms known in the art may also be utilized.

Finally, a person setting up traffic management unit 10 connects the light assembly 16 to the top of stand base 11 and secures it thereto with a locking pin (not shown), which thereby also powers on traffic management unit 10. The traffic management unit starts and remains in a flashing stop light mode until all configured traffic management units are on and operational, thereafter, the traffic management units remain in solid stop light mode until the operator programs a different operating condition, whether it be a manual mode or an automatic mode.

After system initialization, traffic management unit 10 may be programmed or re-programmed using a handheld remote controller 32 that is not shown in FIG. 1, but which is shown in and described with reference to FIG. 10. In addition, controller circuitry at a remote management site 33 some distance from control unit 10 may be used to transmit encoded control signals to traffic management unit 10 via an RF link to program or re-program the operation of traffic management unit 10 and to change the sequence and timing that the LED lights of light assembly 16 are energized. This operation is not represented in FIG. 1, but controller circuitry at remote management site 33 is also shown in and described with reference to FIG. 10.

FIG. 2 shows a perspective view with more details of the stand base 11 of traffic management unit 10. The relative dimensions of various pieces of base 11 are distorted some only to assist in better understanding the relationship of the various pieces that make up base 11. As previously mentioned, there are five legs 13 but only three are shown to avoid cluttering the drawing. Also as previously mentioned, such stand bases 11 are known in the art so a very detailed description is not given here. Base 11 comprises a lower vertical portion 20 to which are attached extendable legs 13. Legs 13 each have an outer end 13*a* that is used to adjust the length of the leg to better position base 11 on surfaces that are not level and/or are not even. The upper end of legs 13 are rotatably attached to a sliding sleeve 27 that slides vertically along lower vertical portion 20 as indicated by arrow W1. The lower end of each leg 13 is movably attached to the outer end of a support element 25, and the inner end of each support element 25 is rotatably attached to a fixed hinge point 26. FIG. 2 shows the legs 13 extended. To collapse legs 13, sliding element 27 is first unlocked and is then slid upward in the direction of arrow W1 which causes legs 13 to fold upward in the direction of arrows W2 to be alongside lower vertical portion 20. Legs 13 are unfolded for use by reversing this procedure.

Figure 3C:
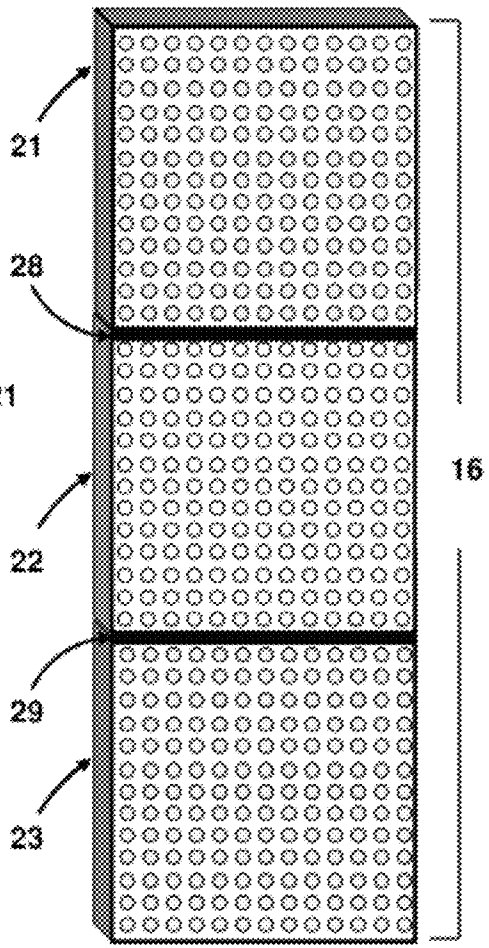
FIGS. 3A-3C show one way in which the LED light display unit of the traffic management unit folds up for storage.
Figure 3B:
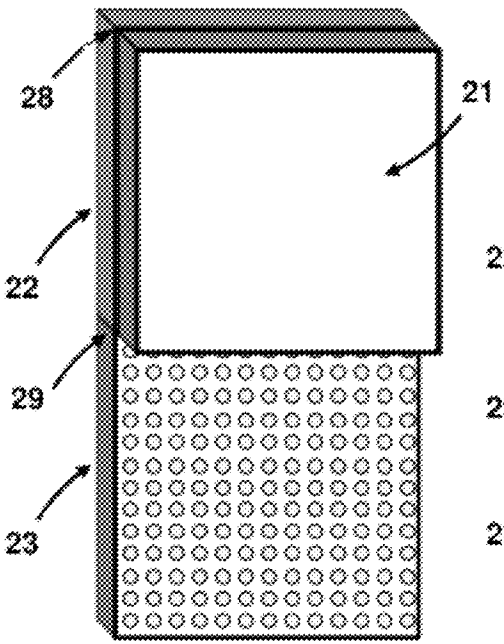
Figure 3A:
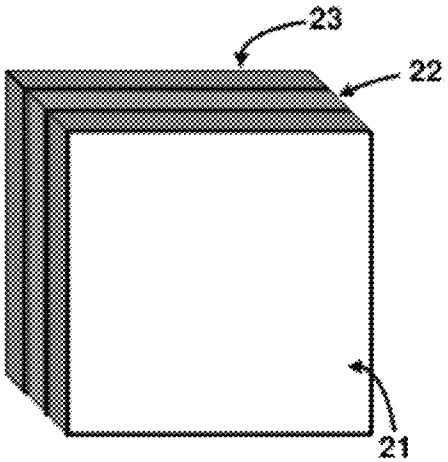
Figure 4C:
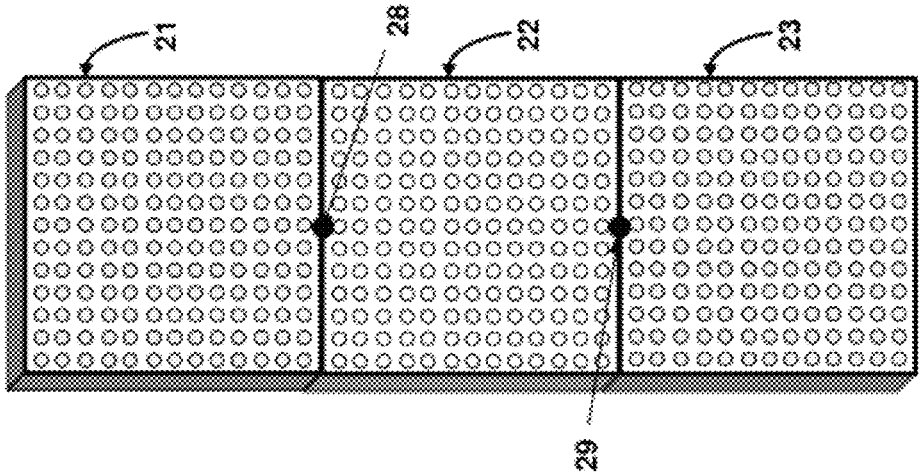
FIGS. 4A-4C show a second way in which the LED light display unit of the traffic management unit folds up for storage.
Figure 4B:
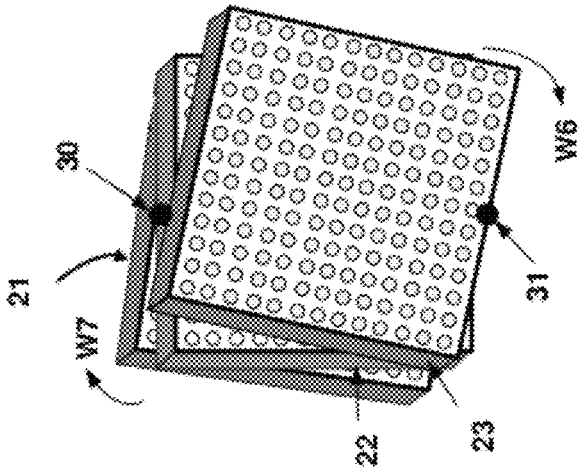
Figure 4A:
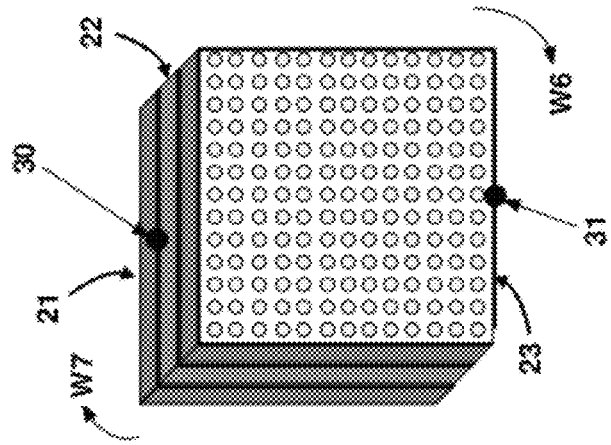
Figure 5C:
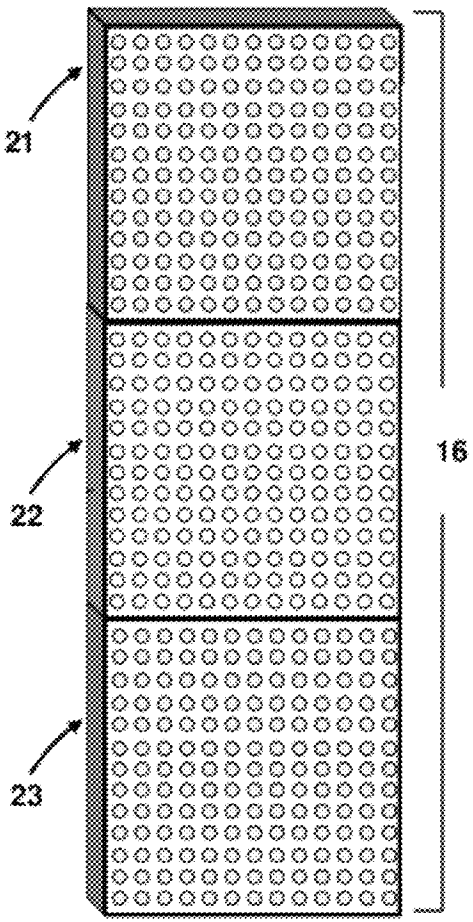
FIGS. 5A-5C show a third way in which the LED light display unit of the traffic management unit folds up for storage.
Figure 5B:
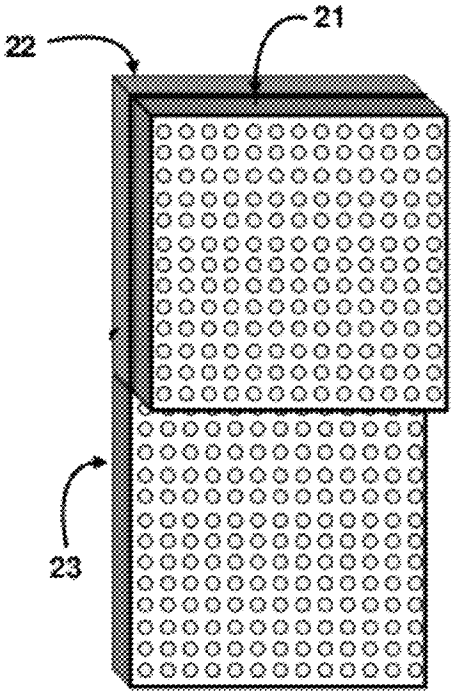
Figure 5A:
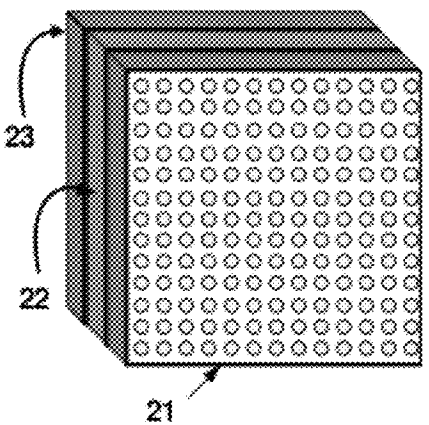
Figure 6:
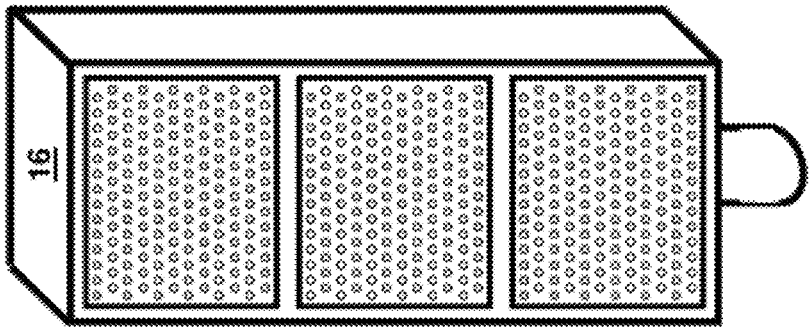
FIG. 6 shows an exemplary LED light display for use on a traffic management unit.

LED light assembly 16 may be a fixed arrangement of all the LEDs that make up assembly 16, such as shown in FIG. 6, or it may be a collapsible arrangement of the LEDs such as shown in FIGS. 3A-3C, 4A-4C and 5A-5C. FIGS. 3A-3C show an arrangement in which the LEDS that comprise each of the sets of red, orange and green LEDs are mounted on separate segments 21, 22 and 23 of light assembly 16, and the three light segments are connected together at hinged joints. As shown in FIG. 3C, segment 21 is attached to segment 22 by a hinge 28, and segment 22 is attached to segment 23 by a hinge 29. Light assembly 16 may also utilize other forms of light emitters including liquid crystal displays (LCDs) that can be programmed to display millions of different colors.

When LED light assembly 16 is to be put into use mounted on top of tripod base 11, light assembly 16 is taken out of its storage container. Light assembly 16 comprises three segments 21, 22 and 23 that are initially folded up about hinges 28 and 29 as shown in FIG. 3A. LED segment 23 is initially unfolded about its hinge 29 until it is coplanar with segment 22 as shown in FIG. 3B. There is a locking mechanism that locks segments 22 and 23 in this co-planar position that is not shown.

LED segment 21 is then unfolded about its hinge 28 until it is coplanar with segment 22 as shown in FIG. 3C. There is a locking mechanism that locks segments 21 and 22 in this co-planar position that is not shown. There is also printed circuit wiring (not shown) interconnecting segments 21 and 22, and segments 22 and 23. There is also a connector (not shown) on the back of segment 22 to which a connector on the top end of cable 18 in FIG. 1 is connected. In addition, there is an adapter on segment 22 (not shown) used to mount LED light assembly 16 on top of the upper vertical portion 12 of tripod base 11 as shown in FIG. 1. With LED light assembly 16 being fully unfolded, it is ready to be mounted on top of stand base 11 and secured thereto with a locking pin (not shown), which thereby also powers on traffic management unit 10.

FIGS. 4A-4C show an alternative arrangement of LED light assembly 16 in which the red, orange and green LEDs are mounted on separate segments 21, 22 and 23, and the three segments are rotatably connected together at hinge pin joints 30 and 31. As shown in FIG. 4A, segment 21 is attached to segment 22 by hinge pin 30, and segment 22 is attached to segment 23 by a hinge pin 31.

When the LED light assembly 16 shown in FIGS. 4A-4C is to be put into use, it is taken out and segments 21, 22 and 23 are initially folded up about their hinge pins 30 and 31 as shown in FIG. 4A. LED segment 23 is unfolded about its hinge pin 30, and segment 21 is unfolded about its hinged pin 31, as shown in FIG. 4B. Segment 23 is rotated clockwise in the direction of arrow W6, and segment 21 is rotated clockwise in the direction of arrow W7 until the three LED segments 21, 22 and 23 are aligned as shown in FIG. 4C. There is a locking mechanism that locks segments 22 and 23 in the positions shown in Figure a 4C that is not shown.

In FIGS. 5A-5C is shown a third arrangement in which the LED light assembly 16 of the traffic management unit 10 folds up for storage. In this arrangement, the three LED segments 21, 22 and 23 slide with respect to each other to set them up for use. Briefly, FIG. 5A shows the LED segments 21, 22 and 23 nested together for storage. In FIG. 5B, segment 23 is slid downward below segment 22 to be exposed, and is locked in this position. In FIG. 5C, segment 21 is slid upward above segment 22, and is locked in this position. More particularly, this third arrangement consists of light assembly enclosures that are anchored to the left and right sides of a middle enclosure, and as such, they slide back and downward from the top and forward and upward from the front from their expanded rest positions during collapsing to one-third in size for stowage purposes. The middle LED segment 22 has a channel groove (not shown) on its left and right side surfaces of the enclosure that allow the top LED segment 21 to slide up, and allow the top LED segment 23 to slide down to their respective extended positions as shown in FIG. 5C for expansion or collapse action. There are mating connectors at the end of each channel groove (not shown) to provide power and signal connections to the top LED segment 21 and the bottom LED segment 23 when they are fully extended.

FIG. 6 shows a variant LED light display 16 for use on a traffic management unit 10 that is not folded up in any manner. There are the three sets of colored LEDs mounted in a single housing with no hinges or hinge pins. As required, there may be a second set of LED lights facing in the direction that is opposite to those LEDs shown in FIG. 5, so the second set of lights is not shown in FIG. 6.

Figure 7:
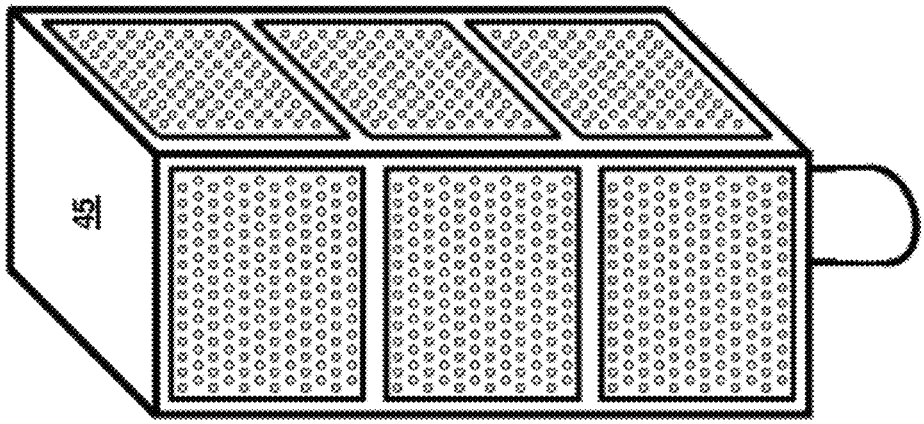
FIG. 7 shows a second exemplary LED light display for use on a traffic management unit.

FIG. 7 shows a second variant LED light display 45 for use on a traffic management unit 10 that has LED light displays facing in perpendicular directions to form a four way light.

Figure 8D:
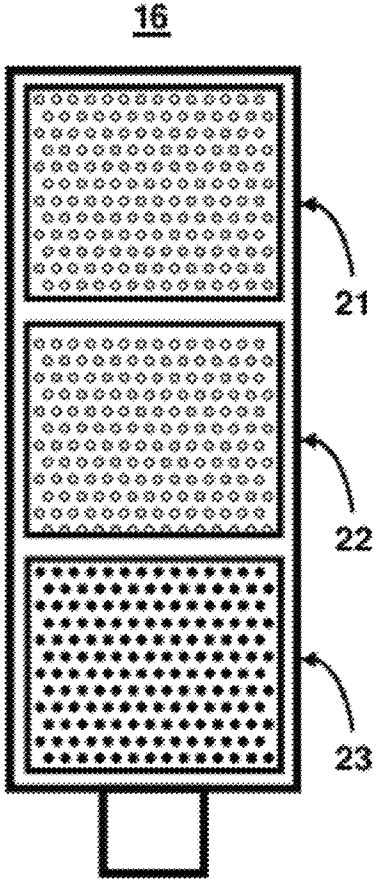
FIGS. 8A-D show an LED light display unit energized to show red, orange and green light signals.
Figure 8C:
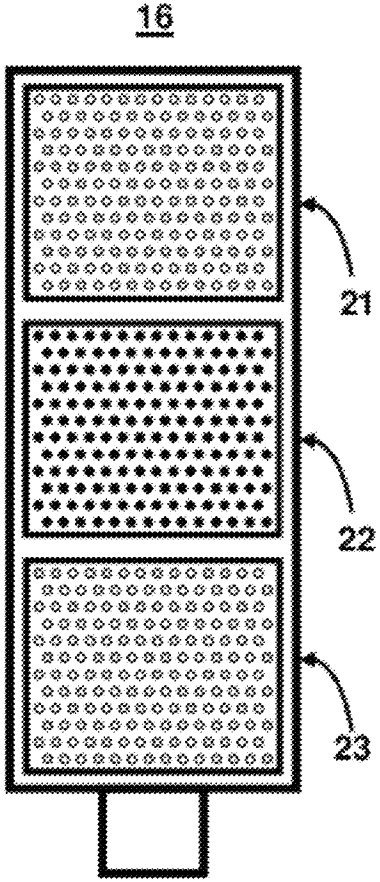
Figure 8B:
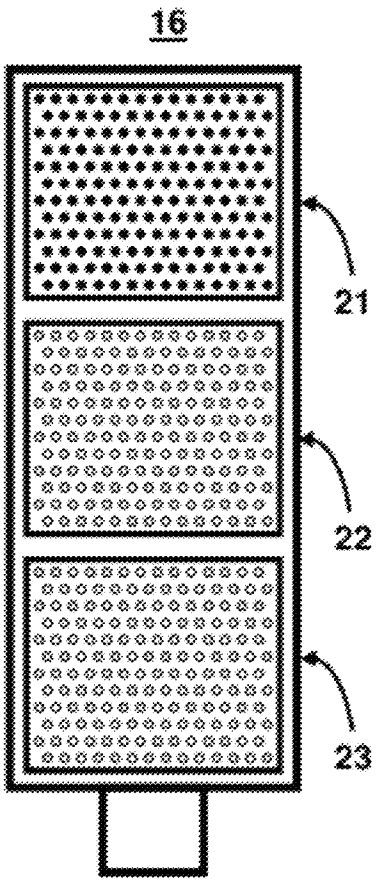
Figure 8A:
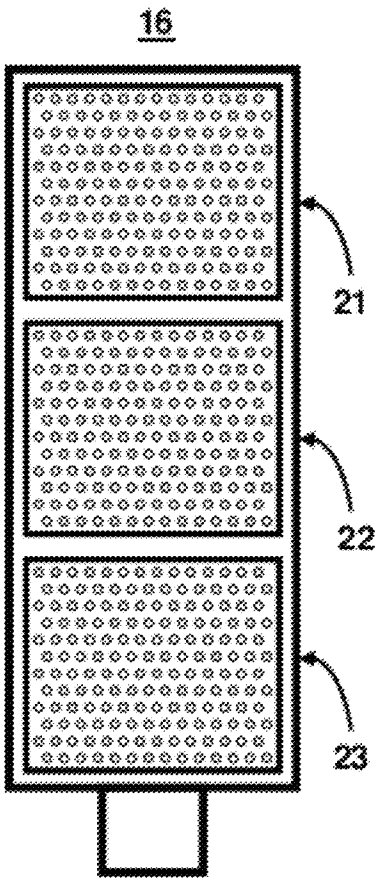

FIGS. 8A-8D illustrate different ones of the LED light sets 21-23 being lit during normal operation. The LEDs in sets 21 will emit red light, the LEDs in set 22 will emit orange light, and the LEDs in set 23 will emit green light. In FIG. 8A, none of the LEDs are energized to emit light. Thus, all the LEDs are represented as small circles. In FIG. 8B, the LEDs in set 21 are shown as black dots indicating that these LEDs are energized and all are emitting red light. In FIG. 8C, the LEDs in set 22 are shown as black dots indicating that these LEDs are energized and all are emitting orange light. In FIG. 8D, the LEDs in set 23 are shown as black dots indicating that these LEDs are energized and all are emitting green light. In a manner known in the art, the different colored LEDs are energized in a sequence for normal red-yellow-green light operation, or one of the sets of colored LEDs may be energized in a blinking manner.

Figure 9:
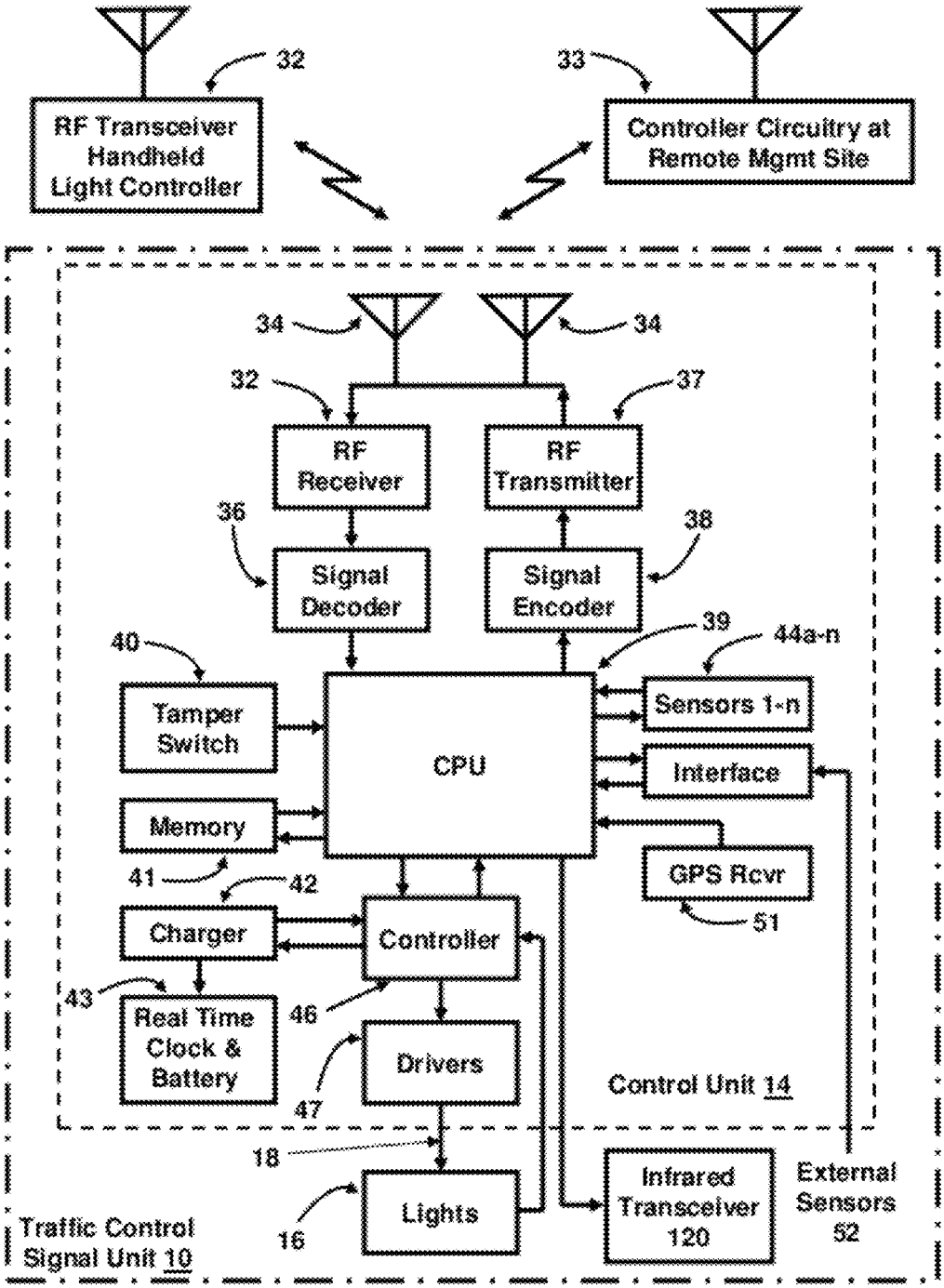
FIG. 9 is a block diagram of the control unit of the traffic management unit.

In FIG. 9 is shown a schematic block diagram of the control unit 14 that is attached to stand base 11 during normal operation of a traffic management unit 10 as shown in FIG. 1. Also shown in FIG. 9 is a radio frequency (RF) handheld transceiver light controller 32 that is used to communicate with and control traffic management unit 10 using RF signals. After traffic management unit 10 is set up and working, a person using a handheld controller 32 can manually change the light being emitted by ones of the LEDs of LED light display 16. Thus, a single flag man or policeman on a road works project can easily control the traffic in a work area, or a policeman or emergency personnel can more easily control the traffic in an accident or emergency area, whereas in the past two or more people may have been required.

The RF handheld transceiver light controller 32 can also be used to send RF signals to traffic management unit 10 to program or re-program unit 14 for automatic operation of unit 10, and to inquire as to the status of various system functions of unit 14. Handheld controller 32 can also receive RF signals from traffic management unit 10 that indicate what LED lights are presently lit, the programmed operation of the lights, the charge level of the battery, signals from sensors connected to traffic management unit 10, etcetera.

More extensive controller circuitry may be located at a remote management site 33 that is located at some distance from a traffic management unit 10. Similar to handheld controller 32 signals may be transmitted from remote site 33 to program or re-program unit 14, to inquire of the status of various system functions, and to otherwise control all functions of traffic management unit 10. Traffic management unit 10 may also transmit signals to the controller circuitry at remote site 33 such as, but not limited to, the programmed operation of the lights, the charge level of the battery, signals from sensors connected to traffic management unit 10, etcetera.

The heart of control unit 14 of traffic management unit 10 is a central processing unit (CPU) 39 that operates under control of a program stored in memory 41 to control all functions of traffic management unit 10. CPU 39 may be manually or remotely controlled as described in the previous paragraphs.

To remotely operate control unit 14, there is an internal RF receiver 32 that has input thereto security encoded RF managements received by an embedded antenna array comprising antennas 34. The security encoded RF managements are transmitted by either the handheld controller 32 or the controller circuitry at remote management site 33. The managements received by RF receiver 32 are first decoded by signal decoder 36 and are then input CPU 39 to be acted upon and stored.

Status signals described above are transmitted to the handheld controller 32 or the controller circuitry at remote management site 33. The status signals come from CPU 39 and are security encoded by signal encoder 38 before being used to modulate RF signals being transmitted by RF transmitter 37 via antennas 34.

Connected to CPU 39 is a memory 41 in which is stored a program run by CPU 39 to control all functions performed by traffic management unit 10. CPU also stores in memory 41 control signals received from handheld controller 32 and from the controller circuitry at remote management site 33. The stored managements are used in conjunction with the stored program to operate traffic management unit 10 as specified by received control signals.

Responsive to received and stored control signals CPU 39 generates light signals that are input to controller 46. Controller 46 decodes the light control signals from CPU 39 and forwards them to drivers 47 which provide output signals with enough power to operate specified LEDs in LED light display 16. The output signals are sent to LED light display 16 where appropriate ones of the LEDs are lit, such as shown in FIGS. 7A-7C (red-orange-green). If LED light display 16 is disconnected in an unauthorized manner, this is sensed and CPU 39 under control of its stored program causes a message to be transmitted to the controller circuitry at remote management site 33.

While there is a main battery 15 fastened to lower end of lower vertical portion 20 of base stand 11, as shown in FIG. 1, which is the main power source for traffic management unit 10 there is a second, backup battery 43 located with control unit 14. (See FIG. 9) This backup battery 43 is charged but is not normally used until the external battery 15 is depleted or has been disconnected. At this time, CPU 39, under control of its stored program, causes a warning message to be transmitted to the controller circuitry at remote management/control site 33.

Mounted inside control unit 14 of traffic management unit 10 and connected to and monitored by CPU 39 is a tamper switch 40. Switch 40 provides an output signal whenever traffic management unit 10 is moved, which includes stand 11 of portable traffic management unit 10 on which the control unit 14 is attached. Once the CPU 39 in control unit 14 of traffic management unit 10 is initialized for operation, any movement of traffic management unit 10 beyond a defined small amount causes an output from switch 40. CPU 39 is responsive to the output from switch 40 to read the output of a GPS receiver 51 that is also connected to CPU 39.

CPU 39 then controls RF transmitter 37 to periodically cause the transmission of a warning signal and a GPS location signal to the controller circuitry at remote management site 33. Responsive thereto personnel at remote management site 33 can dispatch a police and/or maintenance personnel to the site where the traffic management unit 10 is located from which the warning signal is being transmitted. In the event that traffic management unit 10 is being wrongfully moved or stolen the changes in the periodic GPS readings analyzed by CPU 39 indicate the degree of movement and police will be dispatched. The police will continually receive updated position information from remote management site 33.

Inside control unit 14 and mounted elsewhere on base stand 11 of traffic management unit 10 are various types of sensors 44*a-n* & 52 that are selected and installed as desired for particular applications where a traffic management unit 10 is located and functioning. All sensors and other devices, internal 44*a-n* and external 52, are connected to CPU 39 which may analyze, store and transmit the sensor and other signals via RF transmitter 37 to the controller circuitry at remote management site 33. Internally mounted sensors include a battery level sensor, GPS receiver 51 and a radiation detector. External sensors can include a video camera, an explosive detector, a humidity sensor, a temperature sensor, air quality sensor, water quality sensor, UV radiation sensor, vehicle proximity sensor, emergency vehicle transmitter sensor, accelerometers, deployed height of unit sensor, traffic counter, seismic sensor, etcetera. An accelerometer provides orientation feedback (vertical, horizontal and angular) and information regarding vibration conditions.

Figure 14:
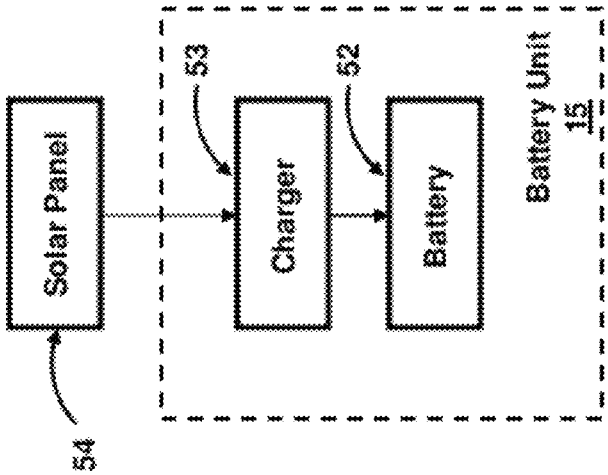
FIG. 14 is a block diagram of a solar powered charging system for the battery of the traffic management unit.

In FIG. 14 is shown a block diagram of a solar powered charging system for the battery of the traffic management unit 10. Battery unit 15 is fastened to lower portion 20 of stand base 11 and it contains a rechargeable and replaceable battery 52 that supplies electrical power to operate control unit 14 and to illuminate LED display 16 atop stand base 11. Battery 52 is preferably a high capacity, sealed battery of a type well known on the art. As previously described, the electrical power is carried via coiled cable 18 that is fully contained inside, and protected by, hollow upper and lower vertical portions 12 and 20 of stand base 11. Inside battery unit 15 there is also a battery charger 53, of a type known in the art, that is used to interface a solar panel and a rechargeable battery and control the charging current to battery 52 depending on the output from solar panel 54. Lastly, the solar powered charging system comprises a solar panel 54 that is mounted on top of LED display 16 atop stand base 11. Solar panel 54 is not specifically shown in any of the other Figures. Electrical current output from solar panel 54 is carried via a conductor in cable 18 to charger 53 in battery 52.

In FIG. 10 is shown a block diagram of handheld light controller 32 for programming and manually operating traffic management unit 10. There are a number of similarities between handheld light controller 32 and control unit 14 in FIG. 9. There is an antenna array 62 that performs the same functions as antenna array 34 in FIG. 9. For receiving RF signals, there is an RF receiver 60 that performs the same functions as RF receiver 32 in FIG. 9. For decoding received encrypted RF signals, there is a signal decoder 63 that performs the same functions as signal decoder 36 in FIG. 9. For encoding signals to be transmitted by handheld light controller 32, there is a signal encoder 64 that performs the same functions as signal encoder 38 in FIG. 9. For actually transmitting RF signals from handheld light controller 32, there is RF transmitter 61 that performs the same functions as RF transmitter 37 in FIG. 9. Being as the functions of elements 60-64 are the same their description is not repeated here There is also a CPU 65 that operates under control of a program stored in memory 67 and individual operational programming CPU 39 and memory 41 alike in FIG. 9. Accordingly, the details of CPU 39 and memory 41 are not repeated here.

Handheld light controller 32 also has a display 70 that is driven by a controller 69 that processes signals output from CPU 65 to display various information about the operation of traffic management unit 10 and for programming the operation of same. Display 70 may be an LED display for viewing information about the programming and operation of handheld light controller 32, or may be a touch screen display which is usefully for providing manual inputs to handheld light controller 32 concerning the programming and operation of handheld light controller 32. These touch screen inputs are use in conjunction with "buttons" 71-74 on handheld light controller 32 that are described in more detail hereinafter.

There is also a tamper switch 66 in handheld light controller 32 that performs the exact same function as tamper switch 40 in FIG. 9 so its operation is not repeated here for the sake of brevity.

One difference between control unit 14 and handheld light controller 32 is that the latter has an integrated vibrator and/or a speaker 68. When an RF signal is received by controller 32, the received message or information is displayed on display 70 the vibrator can be activated to get the attention of a person using controller 32. If a speaker is provided, the received message or information is verbally output via the speaker.

There are four buttons on handheld light controller 32 that are connected to CPU 65 and used for manual control and programming of traffic management unit 10. The first button is a "MDE" button and it is used to program traffic management unit 10. The second button is an "M/A" button and it is used for selecting either the manual mode of operation of unit 10 or the automatic mode of operation of unit 10 responsive to program and setup instructions stored in memory 67. The third button is an "RST" button and it is used for resetting all LEDs (21, 22 and 23) of LED display 16 (FIG. 1) to a "Red" state and placing unit 10 in its manual mode of operation where a person using traffic management unit 10 must manually select when and how long LED lights 21, 22 and 23 of LED display 16 are lit. The fourth button is a "CHG" button and every time it is touched it cycles the LED lights 21, 22 and 23 of LED display 16 through one of their red, orange and green states.

There are also some LED indicator lights on handheld light controller 32 that are not shown in FIG. 10 which are include in display 70, and which indicate such things as when controller 32 is in its ON operational state, if traffic management unit 10 is active and in use, indicating which of the red, orange and green lights are lit at any moment in time, and if the controller is presently in its manual mode. LED lights may be provided to indicate other useful information to the user of traffic management unit 10. Such other information may include error conditions detected by control unit 14.

When traffic management unit 10 is in its automatic mode for operating LED lights 21, 22 and 23 of LED display 16, a person using handheld light controller 32 can also program the amount of time that the LED lights are lit while cycling through their operation, and can also select modes such as one set of the LED lights (21, 22 or 23) continuously blinking red, orange or green.

Figure 11:
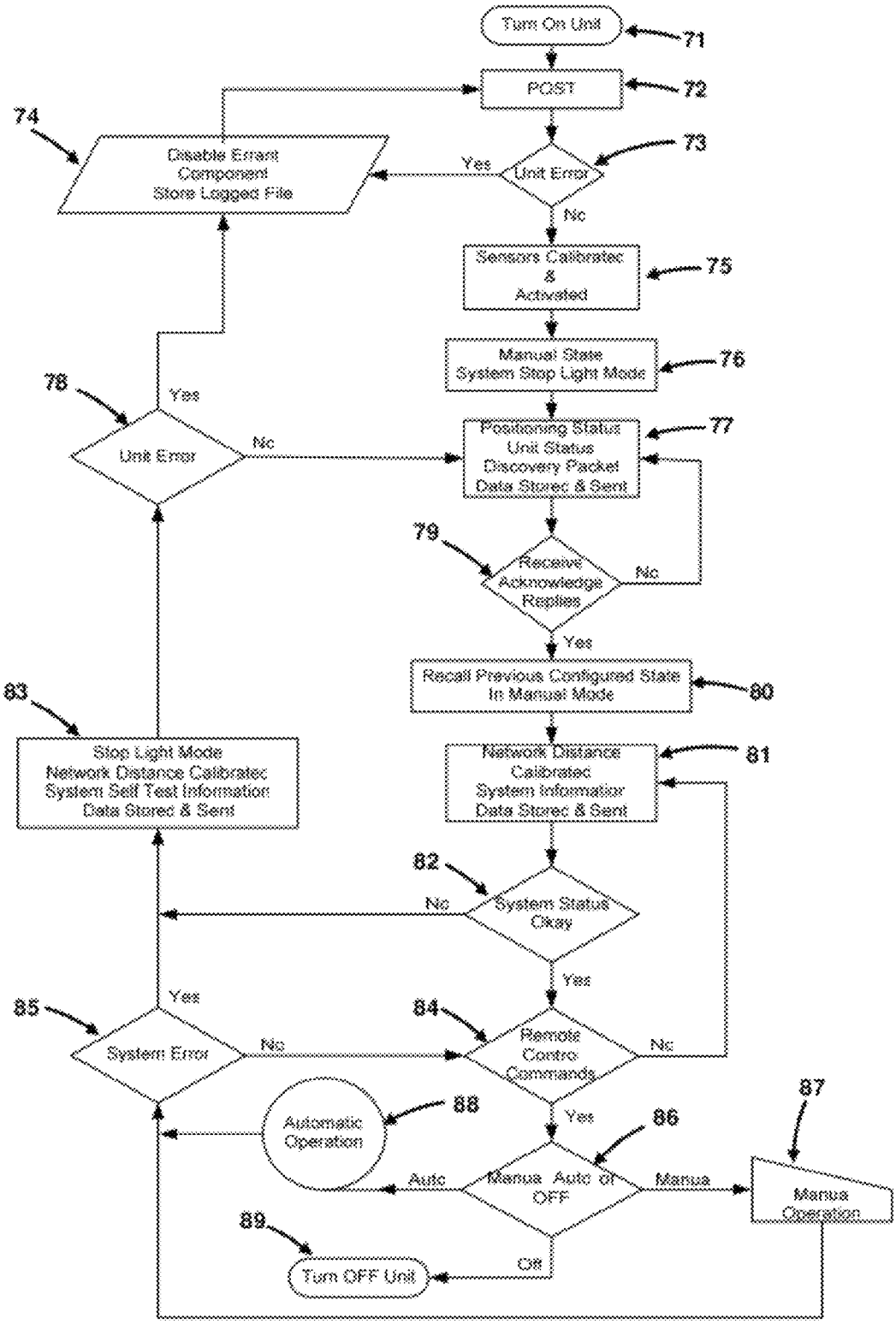
FIG. 11 is a flow chart of the operational steps performed by the traffic management unit.

FIG. 11 is a flow chart of the operational steps performed by traffic management unit 10 during normal operation. At block 71, control unit 14 is manually powered on via an internal power switch inside a locked container in which control unit 14 is contained. At block 72, CPU 39 in unit 14 receives information from various components of traffic management unit 10 to be used in the next step to determine if there are any operational errors. At decision block 73, CPU 39 analyzes the information obtained at block 72 and determines if there are any errors/problems in the system. If the decision is YES, the program exits block 73 at YES and proceeds to block 74 where a system component found to have an error or problem is disabled. The program then loops back to block 72 to again gather information and again determine at block 73 if there are any other operational errors.

After all error and problem checking is completed and system components having errors or problems are disabled, the program exits block 73 at NO and progresses to block 75. At block 75, all sensors 44*a-n* and 52 that are connected to control unit 14 of traffic management unit 10 are activated and calibrated.

The system program then progresses to block 76 where the operation of traffic management unit 10 is initially placed in a manual mode for operating the LED lights 21, 22 and 23 (FIG. 1) The operation then progresses to block 77 where some system information regarding unit 10 is determined, stored and transmitted via RF transmitter 37 (FIG. 9) to controller circuitry at remote management site 33. This information includes the geographical position of the now functioning unit 10.

The program then progresses to decision block 79 where the system watches for an acknowledgment signal to be returned from other configured traffic management unit 10 and the controller circuitry at remote management site 33 verifying that the information transmitted thereto at block 77 has been received. Until the acknowledgment signal is received, the program exits block 79 at NO and cycles back to block 77 where the system information is retransmitted to other configured traffic management unit 10 and remote management site 33. When an acknowledgment signal is received, the program exits block 79 at YES and progresses to block 80.

At block 80, the system program stored in memory 41 recalls the previous operational state of traffic management unit 10. The program then progresses to block 81 where unit 10 communicates with other units 10 in its near vicinity, determines the distance between the various units 10, stores this information and transmits the same information to remote management site 33.

The next step in the operation, at decision block 82, is to determine if the operation of unit 10 is acceptable. As mentioned above the operation of unit 10 at this time is the same as it was when unit 10 was previously shut down. If the decision at block 82 is NO, the program branches to block 83 where information such as the distance between nearby units 10 and system self test information is transmitted via RF transmitter 37 (FIG. 9) to remote management site 33. After the information has been transmitted, the program progresses to block 78 where it is decided if there are any system errors. If the decision is NO, the program branches to block 77 to repeat the previously described steps starting thereat. If the decision at block 78 is YES, the program cycles back to block 72 and the previously described steps starting thereat are repeated. When there is a system error, the operation of LED light assembly 16 changes so that red LED lights 21 of LED light display 16 flash until the system error is cleared.

When the decision at block 82 is finally determined to be YES, the program progresses to decision block 84 to watch for encoded RF signals received from handheld light controller 32. This step is performed periodically and as long as no signal are received from handheld controller 32 the program exits block 84 at NO and cycles back to block 81 to repeat the steps performed at blocks 81 and 82 as previously described. Eventually, when a control signal is received from handheld controller 32 indicating a mode of operation for LED lights 21, 22 and 23 (FIG. 1), the program progresses to block 86 where it is determined from the signal received from handheld controller 32 which operational mode traffic management unit 10 is to operate in.

A first choice at block 86 is that the received signal from handheld controller 32 indicates that control unit 14 is to be turned off. In this first case, the program progresses to block 89 where control unit 14 is turned off in an orderly manner. A second choice at block 86 is that the received signal from handheld controller 32 indicates that control unit 14 is to be operating in manual mode. In this second case, the program exits decision block 86 and progresses to block 87 and the manual mode is enabled. The LED lights 21, 22 and 23 will be lit red, orange or green or will be placed in a one color blinking mode as indicated by signals subsequently received from handheld controller 32. Following enablement of the manual mode of operation, the program progresses to block 85 which is described hereinafter. A third choice at block 86 is that a received signal from handheld controller 32 indicates that control unit 14 is to be placed in its automatic mode, and if this is the case, the program progresses to block 88 where automatic operation of LED lights 21, 22 and 23 is enabled. In automatic mode the red, orange and green LEDS of lights 21, 22 and 23 are sequentially operated in a time sequence as previously stored in control unit 14. The timing sequence may be reprogrammed per other steps in the stored program.

Following performance of a designated manual operation in block 87 or initiation of an automatic operation in block 88, the program progresses to block 85 where the program checks for system errors. When there are no system errors detected, the program cycles back to block 84 and watches for any subsequent commands received from handheld light controller 32. When a system error is detected, the program cycles back through blocks 83 to block 78 and the previously described test for line errors is performed. When there is a system error, the operation of LED light assembly 16 changes so that red LED lights 21 of display 16 flash until the system error is cleared. The operation of traffic management unit 10 from block 72 to 89 continues until a signal is received from handheld light controller 32 to turn off control unit 14. In this event, CPU 39 in control unit 14 performs an orderly shut down sequence and power is turned off to unit 10. This completes the description of the flow chart of operational steps performed during normal operation of traffic management unit 10.

Figure 12:
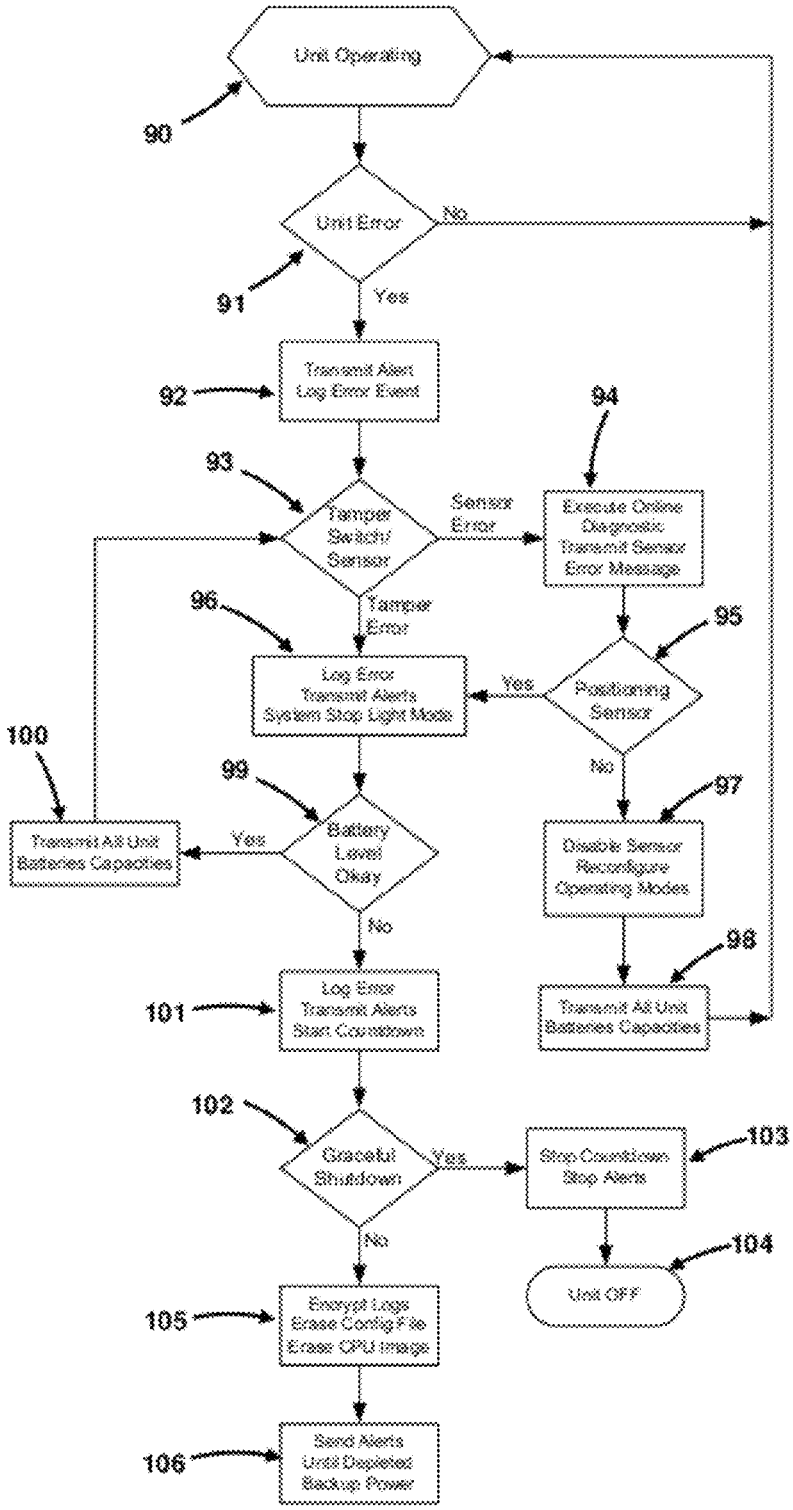
FIG. 12 is a flow chart of the operational steps performed in handling error conditions by the traffic management unit.

In FIG. 12 is shown a flow chart of the operational steps performed in handling error conditions by the traffic management unit 10. At block 90, unit 10 is operating normally as described with reference to FIG. 11. The program first performs a test for any system errors at block 91. As long as no system errors are detected, the program exits block 91 at NO and cycles back around through block 92 to the input of block 91 to continue monitoring for system errors.

In the event that a system error is detected at block 91, the program exits block 91 at YES and progresses to block 92 where the nature of the error is stored in memory 41 of control unit 14 and an appropriate error message is transmitted via RF transmitter 37 back to controller circuitry at remote management site 33. When there is a system error, the operation of LED light assembly 16 changes so that red LED lights 21 of display 16 flash until the system error is cleared.

The program then progresses to block 93 where it is determined if there is a problem with tamper switch 40 or ones of sensors 44*a-n* and 52 in control unit 14. If a problem with one of the sensors is sensed, the program branches to block 94. At block 94, the program executes diagnostic programs to test sensors. In addition, an error message is prepared that is transmitted to remote management site 33 identifying the sensors having problems.

After the error message is prepared and transmitted, the operation progresses to block 95 where it is determined if the error was in the positioning sensor. If it is determined that there is a problem with the positioning sensor, the program branches to block 96 which is described further in this detailed description. The positioning sensor provides an output when traffic management unit 10 is not in a vertical position, and includes an accelerometer that indicates when unit 10 has rapidly moved such as when being struck by a vehicle. If the decision at block 95 is NO, the program progresses to block 97 where the sensor that has been identified as having a problem is disabled and the operating modes of unit 10 are reconfigured for ongoing operation.

The next step is at block 98 where the capacity of external battery 15 and internal battery 43 are determined and the information is placed in a message that is transmitted via RF transmitter 37 to the controller circuitry at remote site 33. The program then cycles back to block 90 and repeats the previously described steps from that point in the operation.

When it is determined at block 95 that there is a positioning sensor error, the program then branches to block 96. As previously described, there is a branch to at block 93 to block 96 when it is determined that there is a problem with tamper switch 40. At block 96, the program logs whatever error has been determined, and prepares and transmits a report of the error to remote management site 33.

Following transmission of the error report, the program progresses to block 99 where the battery level of external battery 15 and internal battery 43 are determined. If the battery level is above a predetermined level, the program branches to block 100 where a message indicating the present battery levels of both batteries is prepared and transmitted to remote management site 33. Following transmission of the battery levels to remote management site 33, the program cycles back to block 93 where the previously described operation is repeated.

If the one or both of the battery levels are determined to be proper at block 99, the program branches to block 101. When external battery 15 is depleted and the system has automatically transferred to internal backup battery 43, the program logs this event and transmits a report of the battery transfer to remote management site 33. At site 33, responsive to the received battery report, maintenance personnel are dispatched to the site of traffic management unit 10 to replace external battery 15.

At the same, at block 101, the program starts a countdown timer of how much time remains for unit 10 to operate on internal backup battery 43.

The program then progresses to block 102 where it is determined if the remaining charge in backup battery 43 is low enough that unit 10 should be gracefully shut down. If the decision is Yes, the program branches to block 103 where the countdown is stopped, and all low power alerts are ceased. The program then goes to block where unit 10 is powered off in an orderly manner.

When the decision at block 102 is NO, indicating that the power level is not yet low enough to shut down init 10, the operation progresses to block 105 where system operational logs are encrypted and stored in memory, and other shut down procedures are performed such as erasing the configuration file.

Finally, at block 106 system shutdown alerts are transmitted via RF transmitter 37 to the controller circuitry at remote management site 33 until power in internal backup battery 43 is depleted. This completes the description of the flow chart of operational steps performed by traffic management unit 10 for handling error conditions.

Figure 13:
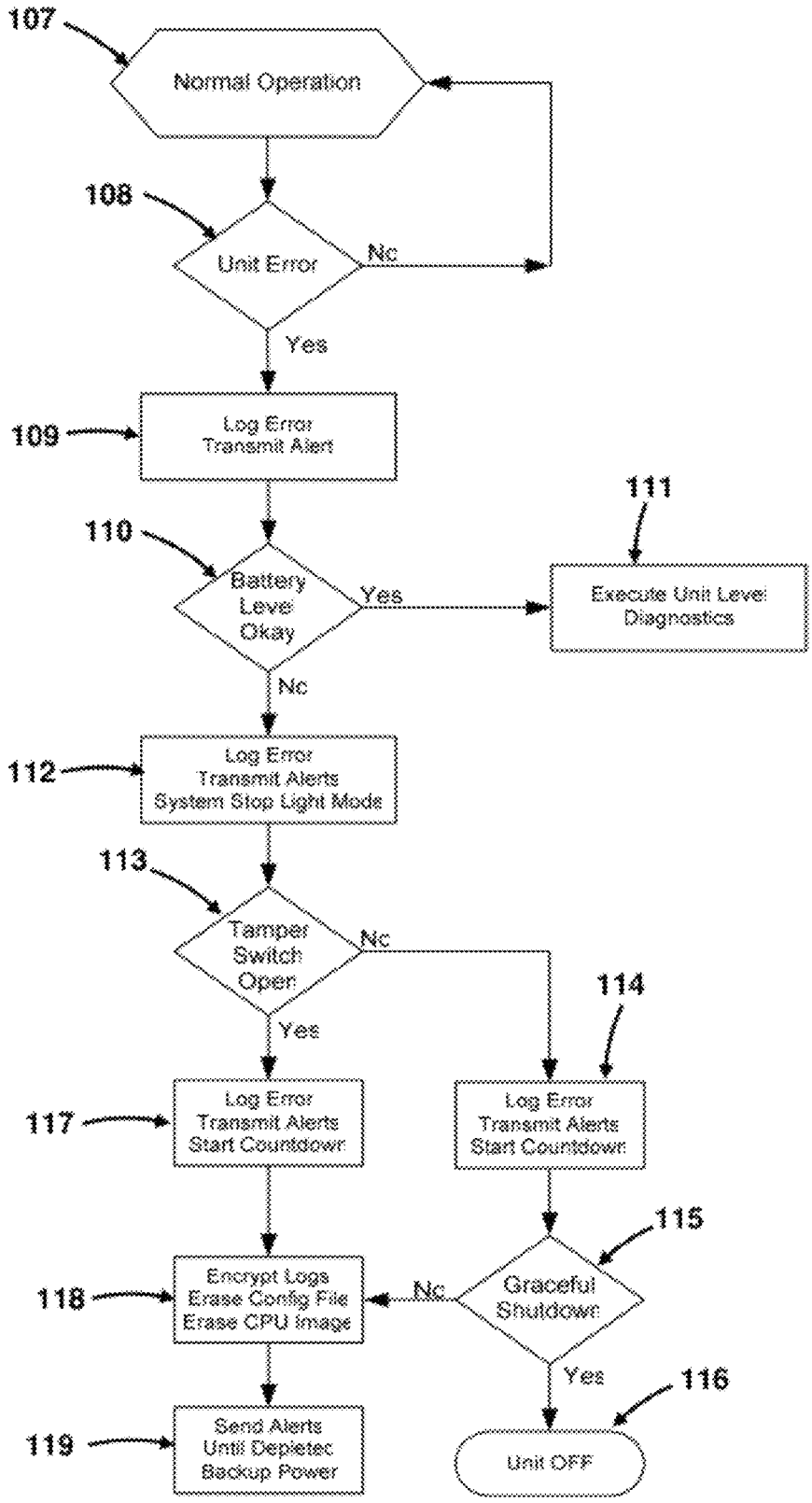
FIG. 13 is a flow chart of the operational steps performed handling a power failure in the traffic management unit.

In FIG. 13 is shown a flow chart of the operational steps performed handling a power failure in traffic management unit 10. While traffic management unit 10 is operating normally, the program operates in a loop comprising blocks 107 and 108. Periodically, at block 108, the program checks other program subroutines to determine if any system power failure errors have been sensed. If the decision is NO, the program cycles back through the loop to block 107 to the input of block 108 to again determine if a system power failure error has been sensed.

When the decision is YES, a system power failure error has been sensed, the program progresses to block 109 where the error is logged, and an appropriate error message is prepared that is transmitted via RF transmitter 37 to the controller circuitry at remote management site 33. The program then progresses to decision block 110.

At block 110, the battery levels of external battery 15 and internal backup battery 43 are checked to determine if they are the source of the power failure. If the battery levels are acceptable, the program braches from block 110 at YES to block 111 where diagnostic tests are performed on various parts of traffic management unit 10.

If the battery levels are not acceptable, the program braches from block 110 at NO to block 112 where the battery condition is logged, and an error message is prepared that is transmitted to the controller circuitry at remote management site 33. The program then progresses to decision block 113.

At block 113, the status of tamper switch 40 in control unit 14 is determined and a course of action taken accordingly. If switch 40 is operated, indicating that unit 10 has been moved, including being knocked over, or as a result of being tampered with, the decision is YES, and the program branches to block 117 where the status of switch 40 is logged, a message indicating that the tamper switch has been operated is prepared, the message is transmitted to remote management site 33, and the program starts a countdown timer of how much time remains for unit 10 to operate on internal backup battery 43. When the decision is NO, the program branches to block 114, and this operation is described further in this detailed description.

The next step is at block 118 where system operational logs are encrypted and stored in memory 41, and other shut down procedures are performed such as erasing the configuration file. Progressing to the final block 119 the message indicating that the tamper switch has been operated is periodically transmitted to the controller circuitry at remote management site 33 until battery power is depleted.

The operation of the system when the decision at block 113 is NO, indicating that the tamper switch has not been operated, is as follows. The program branches to block 114 where the fact that the tamper switch has not been operated is stored in memory 41. A power failure message is transmitted via RF transmitter 37 to remote management site 33. The program also starts a countdown of how much time remains for unit 10 to operate on internal backup battery 43.

At the next step, in block 115, when the countdown is completed, a decision is made if a graceful shutdown should be implemented. If the decision is YES, system elements are powered off in on orderly manner, and at block 116 backup battery power is turned off. If the decision is NO, the program branches to block 118 where the previously described functions for blocks 118 and 119 are implemented. This completes the description of the flow chart of operational steps performed by traffic management unit 10 for handling a power failure.

While what has been described herein is a preferred embodiment of the invention, those skilled in the art will understand that numerous changes may be made without departing from the spirit and scope of the invention.

The invention claimed is:

1. A portable traffic light assembly comprising:

a collapsible stand having an extendable central column, said central column having a first end and a second end distal from the first end;

a plurality of folding legs attached to the first end of the collapsible stand, the legs being adjustable in length, the legs being unfolded and placed on a surface to set up the collapsible stand;

a traffic signal unit secured to the second end of the collapsible stand, the traffic signal unit having illuminating means for indicating traffic control signals that are expanded for use, the illuminating means being collapsed into a smaller size for storage of the traffic signal unit;

a first controller means for controlling the operation of the traffic signal unit;

a first battery means for providing electrical power to the control unit and the traffic signal unit, the first battery means being fastened near the first end of the collapsible stand;

a handheld controller means for transmitting control signals for selectively activating the illuminating means from a location in relative proximity to the portable traffic light assembly; and a receiver means with the portable traffic light assembly for receiving the control signals transmitted by the handheld remote controller means to selectively activate the illuminating means of the traffic signal unit;

wherein the portable traffic signal unit comprises a first, second and third illuminating means that are interconnected and slide linearly with respect to each other, wherein the second illuminating means has channel grooves in its left and right surfaces and the first and third illuminating means have means on their left and right surfaces that rest in and slide in the channel grooves of the first illuminating means, the first illuminating means being slid vertically upward from the second illuminating means to an extended position and the third illuminating means being slid vertically downward from the second illuminating means to an extended position, and when the first and third illuminating means are so extended all three of the illuminating means are visible for operation of the portable traffic light assembly.

2. The portable traffic light assembly of claim 1 further comprising:

a second controller means at a remote location for transmitting control signals to the portable traffic light assembly, the receiver means receiving the control signals transmitted by the second controller means to selectively activate the illuminating means of the traffic signal unit; and a transmitter means with the portable traffic light assembly for transmitting the operational state of the portable traffic light assembly to the second controller means.

3. The portable traffic light assembly of claim 1 wherein the handheld controller means comprises receiver means that receives signals transmitted by the transmitter means of the portable traffic light assembly indicating the operational state of the portable traffic light assembly.

4. The portable traffic light assembly of claim 2 further comprising:

one or more sensor means for sensing physical conditions in the vicinity of the portable traffic light assembly, and the sensed physical conditions are transmitted by the transmitter means with the portable traffic light assembly to the second controller means at a remote location.

5. The portable traffic light assembly of claim 2 further comprising:

a global positioning system receiver for determining the geolocation of the portable traffic light assembly when it is in operation, and wherein the geolocation is transmitted by the transmitter means to the second controller means at the remote location.

6. The portable traffic light assembly of claim 2 further comprising:

a tamper switch that senses when the portable traffic light assembly is moved after initially being set up and operating, and when the tamper switch does sense that the portable traffic light assembly has been moved a warning signal is transmitted by the transmitter means to the second controller means at the remote location.

7. The portable traffic light assembly of claim 1 further comprising:

a strobe light mounted with the illuminating means of the traffic signal unit, the strobe light being used to drawing attention to the illuminating means.

8. The portable traffic light assembly of claim 2 further comprising:

one or more sensor means for sensing physical conditions in the vicinity of the portable traffic light assembly, and the sensed physical conditions are transmitted by the transmitter means to the second controller means at the remote location.

9. The portable traffic light assembly of claim 2 wherein signals transmitted by the handheld controller and the remote controller are encrypted and further comprising:

means associated with the receiver means for decrypting encrypted control signals received from the handheld controller and the remote controller; and means associated with the transmitter means for encrypting signals to be transmitted to the handheld controller and the remote controller.

10. A portable traffic light assembly comprising:

a collapsible stand having an extendable central column, said central column having a first end and a second end distal from the first end;

folding legs attached to the first end of the collapsible stand, the legs being adjustable in length, the legs being unfolded and placed on a surface to set up the collapsible stand;

a traffic signal unit secured to the second end of the collapsible stand, the traffic signal unit having illuminating means for indicating traffic control signals;

a first controller means for controlling the operation of the traffic signal unit;

a first battery means for proving electrical power to the control unit and the traffic signal unit, the first battery means being fastened near the first end of the collapsible stand;

a second controller means for transmitting control signals from a location remote to the portable traffic light assembly;

a receiver means with the first controller means for receiving the control signals transmitted by the second controller means at the remote location to selectively activate the illuminating means of the traffic signal unit; and a transmitter means with the first controller means for transmitting the operational state of the portable traffic light assembly to the second controller means;

wherein the traffic signal unit comprises a first, second and third illuminating means that are interconnected and slide linearly with respect to each other, wherein the second illuminating means has channel grooves in its left and right surfaces and the first and third illuminating means have means on their left and right surfaces that rest in and slide in the channel grooves of the first illuminating means, the first illuminating means being slid vertically upward from the second illuminating means to an extended position and the third illuminating means being slid vertically downward from the second illuminating means to an extended position, and when the first and third illuminating means are so extended all three of the illuminating means are visible for operation of the portable traffic light assembly.

11. The portable traffic light assembly of claim 10 further comprising:

one or more sensor means for sensing physical conditions in the vicinity of the portable traffic light assembly, and the sensed physical conditions are transmitted by the transmitter means to the second controller means at the remote location.

12. The portable traffic light assembly of claim 10 further comprising:

a global positioning system receiver for determining the geolocation of the portable traffic light assembly when it is in operation, and wherein the geolocation is transmitted by the transmitter means to the second controller means at the remote location.

13. The portable traffic light assembly of claim 10 further comprising:

a tamper switch that senses when the portable traffic light assembly is moved after initially being set up and operating, and when the tamper switch senses that the portable traffic light assembly has been moved a warning signal is transmitted by the transmitter means to the second controller means at the remote location.

14. The portable traffic light assembly of claim 10 further comprising:

a handheld controller means for transmitting control signals for selectively activating the illuminating means from a location in relative proximity to the portable traffic light assembly.

15. The portable traffic light assembly of claim 10 further comprising:

a strobe light mounted with the illuminating means of the traffic signal unit, the strobe light being used to drawing attention to the illuminating means.

16. The portable traffic light assembly of claim 10 wherein elements comprising the traffic light assembly are hermetically sealed.

17. The portable traffic light assembly of claim 14 wherein signals transmitted by the handheld controller, the second controller means, and the transmitter means are encrypted and further comprising:

means associated with the receiver means for decrypting encrypted control signals received from the handheld controller and the second controller means; and means associated with the transmitter means for encrypting signals to be transmitted to the handheld controller and the second controller means.

18. The portable traffic light assembly of claim 10 wherein when there are a plurality of portable traffic light assemblies in operation near each other each light assembly transmits its operational status via its transmitter means to the other nearby light assemblies, each of the nearby light assemblies receives the last mentioned operational status transmitted by the other nearby assemblies via its receiver means, and wherein the last mentioned plurality of portable traffic light assemblies cooperate using the operational status information transmitted by the other nearby light assemblies.

19. The portable traffic light assembly of claim 10 wherein signals transmitted by the second controller means are encrypted and further comprising:

means associated with the receiver means for decrypting encrypted control signals received from the remote controller; and means associated with the transmitter means for encrypting signals to be transmitted to the second controller means.

* * * * *